United States Patent [19]

Shen

[11] Patent Number: 4,750,766

[45] Date of Patent: Jun. 14, 1988

[54] AMPHI-LATCH FOR A TUBULAR LOCKSET

[76] Inventor: Richard Shen, P.O. Box 180, Tainan, Taiwan

[21] Appl. No.: 802,186

[22] Filed: Nov. 25, 1985

[51] Int. Cl.[4] ..... E05C 21/00

[52] U.S. Cl. ..... 292/337; 292/169.14

[58] Field of Search ..... 292/244, 245, 169, 337, 292/DIG. 60, 169.14, 1

[56] References Cited

U.S. PATENT DOCUMENTS

| | | | |
|---|---|---|---|
| 4,427,224 | 1/1984 | Bergen | 292/1 X |
| 4,468,059 | 8/1984 | Nelson et al. | 292/1 X |
| 4,564,229 | 1/1986 | Mullich et al. | 292/337 X |

FOREIGN PATENT DOCUMENTS

| | | | |
|---|---|---|---|
| 2152130 | 7/1985 | United Kingdom | 70/2 |

*Primary Examiner*—Richard E. Moore

*Attorney, Agent, or Firm*—Sherman and Shalloway

[57] ABSTRACT

A tubular lockset which includes a backset plate and a drive linkage, both of which are integrated within the rear portion of a latch case. The surface of the backset plate and drive linkage are set with slots and openings for the mounting of drive unit at the fore or rear position within the slots. Two protrusions are provided on one end of the drive linkage, such that the foot of the drive unit engages with the protrusion of the drive linkage and drives the latch case forward and backward. An opening is provided on the drive linkage and slot is provided on each backset plate for the fixation of the drive unit, i.e. the drive unit is fixed within the slot of the backset plate and the opening of drive linkage. The backset length of the amphi-latch can be adjusted to either 60 mm (2⅜") or 70 mm (2¾").

6 Claims, 3 Drawing Sheets

AMPHI-LATCH FOR A TUBULAR LOCKSET

BACKGROUND OF THE INVENTION

The present invention relates to an amphi-latch for a tubular lockset which is mounted within a door and which is adaptable to both 60 mm (2⅜") and 70 mm (2¾") backsets (length from center of bored hole to door edge).

At present, there are two commonly used standard backset lengths, namely 60 mm (2⅜") and 70 mm (2¾"). For this reason, manufacturers presently make two different lengths of latches to meet different backset needs, which causes confusion or inconvenience for new installations or replacements. However, the structure of such latches for these installations is basically the same except for the backset lengths; therefore, to manufacture two latches just for different backset lengths is troublesome. Furthermore, the cost of manufacturing is thus increased.

SUMMARY OF THE PRESENT INVENTION

It is therefore a primary objective of the present invention to obviate the disadvantages of the prior art as described above and to provide and amphi-latch for tubular locksets which can be adjusted for either 60 mm (2⅜") or 70 mm (2¾") backsets by reversing the direction of the slide extension.

DETAILED DESCRIPTION OF THE PRESENT INVENTION

Figure 1:
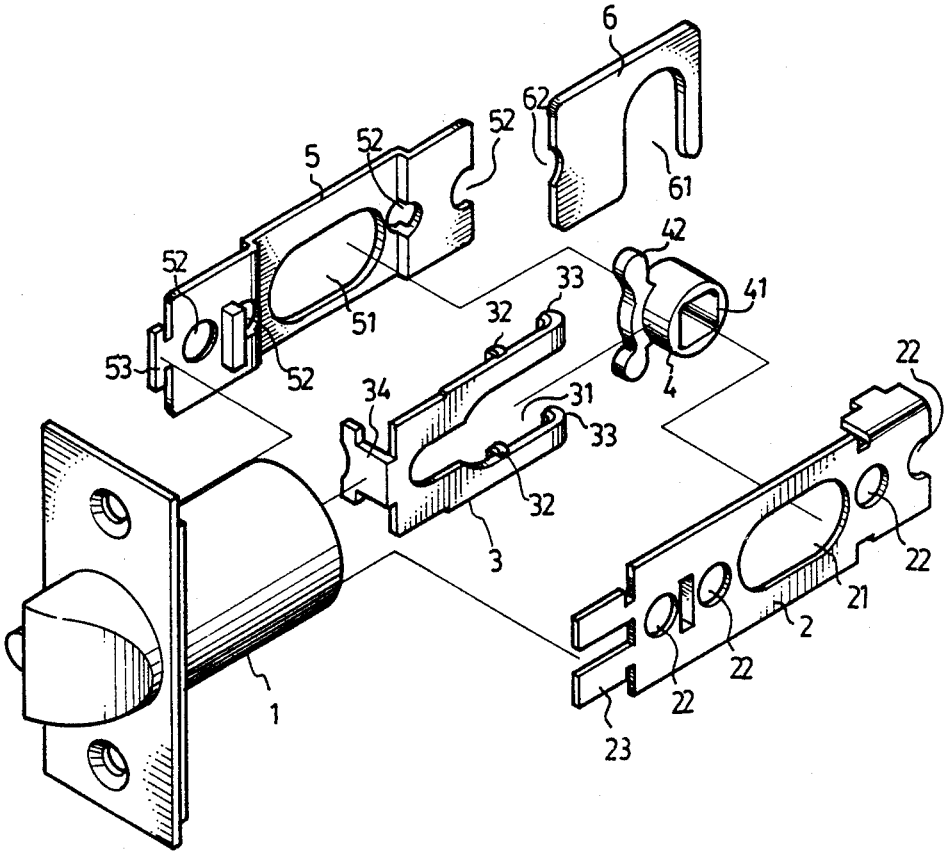
FIG. 1 is an exploded view of an adjustable amphi-latch for tubular lockset in accordance with the present invention.
Figure 3:
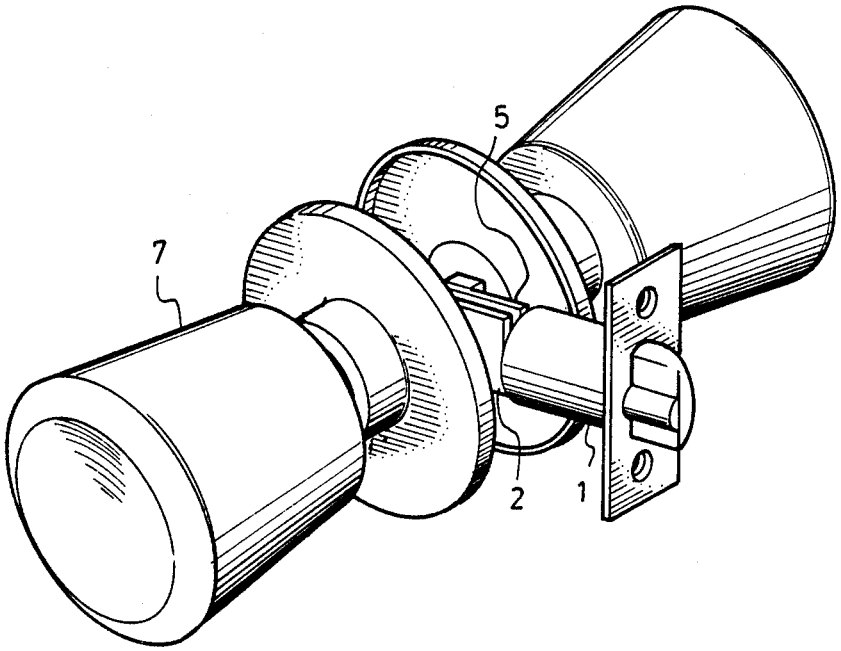
FIG. 3 is a perspective view of a lockset in accordance with the present invention.

With reference now to the drawings, and particularly to FIG. 1, there is shown and illustrated an amphi-latch for a tubular lockset constructed in accordance with the principles of the present invention. The latch portion consists of a latch case (1), two backset plates (2) and (5), a drive linkage (3), a drive unit (4), a slide extension (6) etc., and the arrangement is coupled with a common type of lockset (7) as shown in FIG. 3. The latch protrudes or retracts by rotating an outside or inside knob. The latch case (1) is coupled by means of the catches (23) of the backset plates (2 and 5) while the drive unit (4) of the latch case (1) is coupled with the connector (34) of drive linkage (3) which moves the drive unit (4). Inside the backset plates (2 and 5) and drive linkage (3), slide holes (21 and 51) and slide slot (31) are provided for the sliding of a square-shaped drive unit (4).

The characteristics of the present invention are that the front and rear portions of the slots of the backset plates (2 and 5) are provided with slide holes (21 and 51). There are three holes in each of the backset plates (2 and 5) and semi-circular holes (22 and 52) are provided at the end of each backset plate (2 and 5) for the selection of lockset (7) for coupling. Furthermore, in one of the backset plates (5), the central region protrudes outwardly so as to form a space between the backset plates (2 and 5) such that the slide extension (6) can be inserted. Protruberances (32 and 33) are provided on the central region and end respectively of drive linkage (3). The drive unit (4) is slidable mounted in the slide slot (31) of drive linkage (3). The feet (42) of drive unit (4) engage either the central or rear protruberances (32) or (33) of drive linkage (3). As a result, when the drive unit (4) is rotated, the drive linkage (3) can be moved inward or outward within the latch case (1). When the drive unit (4) is in the proper position, the slide extension (6) can be used to firmly secure the drive unit (4). The slide extension (6) has a U-shaped slot (61) thereon which is set off-center and recess (62) at one edge thereof. In addition, the semi-circular holes (22 and 52) are adapted to cooperate with the knob (7). The amphi-latch is set at the factory for a 2⅜"(60 mm) backset, and the feet of the drive unit (4) are engaged with hooks (32). The U-shaped slot (61) of slide extension (6) is on the right when viewed in FIG. 1. The following are the procedures requested to adjust the latch from a 2¾" (70 mm) backset:

1. Move drive unit (4) backward and engage feet (42) with hooks (33); and
2. Line up slide extension (6) and reverse the direction of U-shaped slot (61), then insert slide extension (6) into position.

Figure 2:
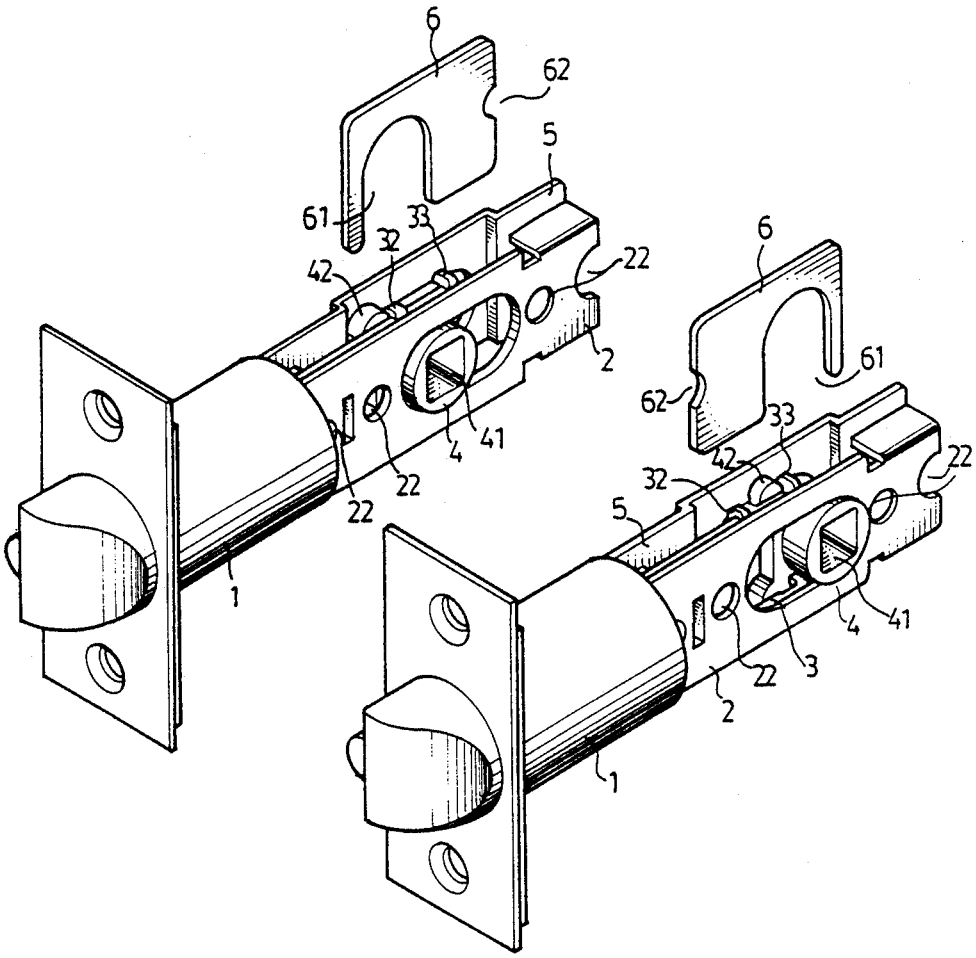
FIG. 2 is a perspective view showing the two types of combinations of latch for the lockset of FIG. 1 in accordance with the present invention.

Referring to FIG. 2, it can been seen that when the drive unit (4) is mounted within the slide holes (21), (51) and slide slot (31), with a distance of 60 mm between the door edge and the axis of drive unit (4), the feet (42) of the drive unit (4) will engage the central protuberances (32) of drive linkage (3) to move the drive linkage (3) in cooperation with the in the rotation of drive unit (4), the U-shaped slot (61) of slide extension (6) holding drive unit (4) in place where the U-shaped slot (61) is arranged nearer to the latch case (1).

Although the invention has hereinabove been described in the presently preferred practice, it will be understood by those having skill in the art that the invention is capable of modification and variation without departing from the scope of the following claims.

What is claimed is:

1. An amphi-latch for a tubular lockset comprising:

(a) first and second parallel backset plates having a reciprocating drive linkage there between, said drive linkage having first and second sets of lateral protruberances, (b) a drive unit disposed between said backset plates and cooperating with said drive linkage such that rotary motion imparted to said drive unit is converted to reciprocation of said drive linkage and (c) a slide extension adapted to fit over said drive unit between said drive linkage and one of said backset plates to secure said drive unit in one of two selectable positions.

2. The amphi-latch of claim 1 wherein said first and second backset plates are provided with substantially centrally located, longitudinally oval apertures, the apertured area of said first backset plate being displaced outwardly a sufficient distance to accommodate said slide extension.

3. The amphi-latch of claim 1 wherein said drive linkage has a substantially U-shaped, longitudinal drive slot accommodating said drive unit, said first and second sets of lateral protruberances being located on the side of said drive linkage facing said first backset plate and being positioned respectively at the open end and substantially midway along and on either side of said drive slot.

4. The amphi-latch of claim 3 wherein said drive unit comprises a substantially cylindrical core having a pair of feet extending therefrom on one side and engaging said lateral protruberances on said drive linkage, one set at a time in one of two selectable positions, said cylindrical core passing through and being rotatable within said drive slot.

5. The amphi-latch of claim 4 wherein said drive unit is held in one of two selectable positions by said slide extension which comprises a substantially rectangular plate sized to fit in the outwardly displace portion of said first backset plate and having a u-shaped opening sized to accommodate said drive unit, said opening being offset toward one edge a sufficient distance such that said selectable positions are achieved by reversal of said slide extension.

6. An amphi-latch for a tubular lockset that is selectively adjustable to one of two positions by means of a drive unit having extensions adapted to engage one of two sets of lateral protruberances on a drive linkage, said drive unit and drive linkage being disposed between first and second backset plates and held in respective engagement by a slide extension, said slide extension having a u-shaped slot adapted to fit over said drive unit said slot being displaced to one side such that selective adjustment of said latch is achieved by repositioning said drive unit such that said extensions engage the other of said two sets of drive linkage protruberances and reversing said slide extension over said drive unit, said slide extension fitting between said drive linkage and said first backset plate in an outwardly displaced portion of said plate, said backset plates and drive linkage having elongated apertures to accommodate said drive unit in either one of the two positions.

* * * * *